United States Patent [19]

Brewer et al.

[11] Patent Number: 4,470,739

[45] Date of Patent: Sep. 11, 1984

[54] AUXILIARY WORKOVER RIG

[75] Inventors: Jimmy D. Brewer, Houma; Albert W. Gunther, Jr., New Orleans; Albert W. Gunther, Sr., Gretna, all of La.

[73] Assignee: Pressure Services, Inc., Houma, La.

[21] Appl. No.: 410,532

[22] Filed: Aug. 23, 1982

[51] Int. Cl.[3] ..... E21B 19/14

[52] U.S. Cl. ..... 414/22; 52/117

[58] Field of Search ..... 166/77.5, 85; 175/52, 175/85; 52/117; 414/22, 745, 910; 212/183, 187, 188

[56] References Cited

U.S. PATENT DOCUMENTS

| | | | |
|---|---|---|---|
| 848,304 | 3/1907 | Hines | 212/188 X |
| 2,690,268 | 9/1954 | Woolslayer et al. | 52/117 X |
| 3,177,944 | 4/1965 | Knights | 414/22 X |
| 3,708,024 | 1/1973 | Back | 414/22 X |
| 3,768,663 | 10/1973 | Turner, Jr. et al. | 175/85 X |
| 3,942,593 | 3/1976 | Reeve, Jr. et al. | 175/85 X |
| 3,949,883 | 4/1976 | Crooke et al. | 414/22 X |
| 3,960,360 | 6/1976 | Elliston | 166/77 X |
| 3,976,207 | 8/1976 | Schultz | 175/85 X |
| 4,230,190 | 10/1980 | Guinn et al. | 175/85 X |

*Primary Examiner*—Robert J. Spar
*Assistant Examiner*—Ken Muncy
*Attorney, Agent, or Firm*—Pravel, Gambrell, Hewitt, Kirk & Kimball

[57] ABSTRACT

An auxiliary rig is used in combination with a primary drilling or workover rig. The primary drilling rig typically includes an elongated upstanding drill tower, a base and a crown block. The auxiliary rig of the present invention includes a racking tower detachably mounted with the upper end of the drill tower to form an extension to the drill tower for receiving interconnected pairs of tubular members to reduce the tripping time of the tubular members into and out of the well. A movable slip and a controller therefor of the auxiliary rig are operably guided by the racking tower for releasably supporting the pairs of tubular members.

8 Claims, 3 Drawing Figures

AUXILIARY WORKOVER RIG

FIELD OF THE INVENTION

The present invention relates generally to the field of earth drilling and oil well workover apparatus and more particularly to means for raising and vertically storing threadedly interconnected pairs of tubular members.

DESCRIPTION OF THE PRIOR ART

In earth drilling and oil well workover operations, a drilling rig having an upstanding mast or tower is typically utilized. A crown block is mounted with the mast to raise or lower singular sections of tubular members. The height of the mast typically is only tall enough to handle the single sections of tubular members. When a drill string made of a plurality of such tubular members is tripped out of the well, each tubular member or pipe joint is individually disconnected from the drill string and stored. In the past drilling or workover rigs handling only single sections of tubular members created delays and increased costs due to the repetition of operations for each said pipe joint.

SUMMARY OF THE INVENTION

Briefly, the present invention is a new and improved auxiliary rig used in combination with a primary drilling or workover rig. The primary drilling rig typically includes an elongated upstanding drill tower, a base therefor, and a crown block with the drill tower for raising and lowering tubular members. The auxiliary rig includes a racking or auxiliary tower having detachable mounting means for mounting the racking tower with the upper end of the upstanding drill tower to form an extension to the drill tower for receiving interconnected pairs of tubular members to reduce the tripping time of the tubular members into and out of the well. Movable slip means and moving means therefor of the auxiliary rig are operably guided by the racking tower for releasably supporting the pairs of tubular members.

DESCRIPTION OF THE PREFERRED EMBODIMENT

Figure 1:
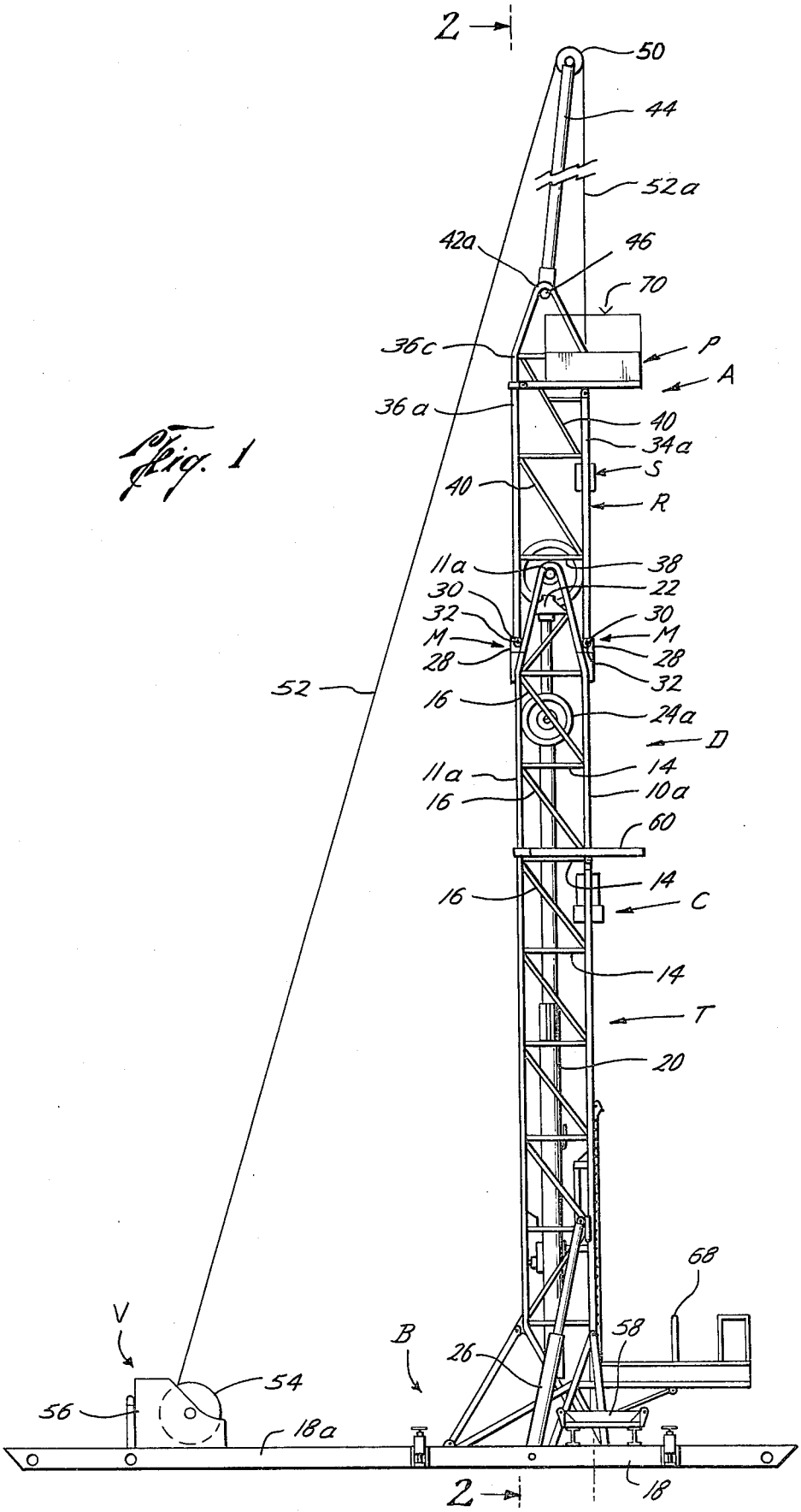
FIG. 1 is a side elevational view of the auxiliary rig of the present invention.

Referring to FIG. 1, an auxiliary rig A is adapted to be used in combination with a primary drilling rig D for raising and lowering tubular members (not shown) for vertical storage of threadedly interconnected pairs of the tubular members of the type forming a drill string (not shown). The primary rig D generally has an elongated upstanding drill tower T, a base B for the drill tower T, and a crown block means C with the drill tower T for raising and lowering tubular members. The auxiliary rig A of the present invention includes a racking or auxiliary tower R having mounting means M for detachably mounting the racking tower R with the drill tower T, and forms an elongated extension of the upstanding drill tower T. The racking tower R receives interconnected pairs of tubular members (not shown), or double-joints, which are raised and lowered by the crown block means C. The auxiliary rig A further includes a pipe rack P with the racking tower R to permit ease in substantial vertical racking and storing of the interconnected pairs of the tubular members with the racking tower R. Movable slip means S for releasably supporting the pairs of tubular members are operably guided by the racking tower R. Moving means V with the base B of the primary rig D move slip means S to selectively tension the drill string.

The primary rig D is well known in the art for oilwell drilling and workover applications. Generally, the upstanding mast or tower T has vertical first and second front members 10*a* and 10*b* and first and second vertical rear members 12*a* and 12*b* interconnected by horizontal braces 14 and cross braces 16. Preferably, braces 14 and 16 do not extend between front members 10*a* and 10*b*.

Figure 2:
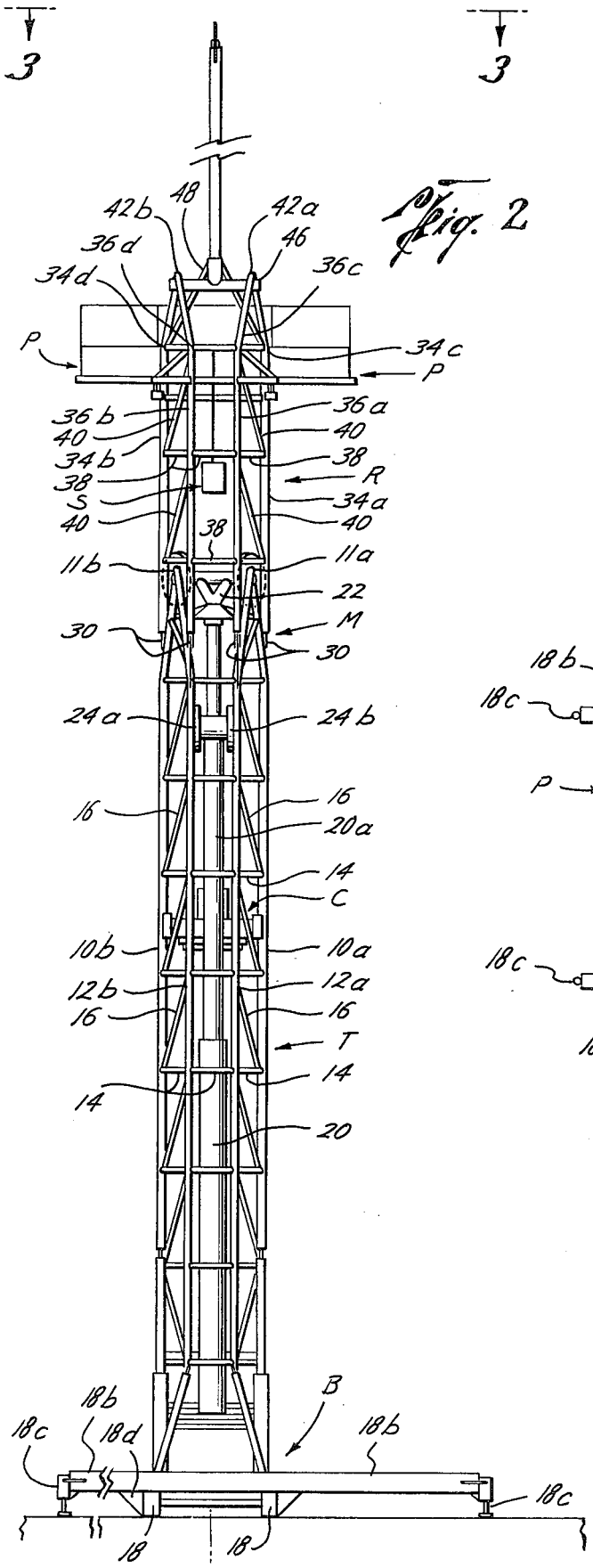
FIG. 2 is a rear elevational view of the auxiliary rig of the present invention taken along line 2—2 of FIG. 1; and, FIG. 3 is a plan view, taken along line 3—3 of FIG. 2, of the auxiliary rig of the present invention.

As is shown in FIGS. 1 and 2, a preferred embodiment of the tower T has the front members 10*a* and 10*b* spaced at a greater distance apart than the rear members 12*a* and 12*b*. The upper end of first front member 10*a* and the upper end of first rear member 12*a* are joined at first joint 11*a*. Similarly, the upper end of second front member 10*b* and the second rear member 12*b* are joined at second joint 11*b*.

The tower T is attached to and supported by the base B, which includes parallel skids 18 upon which the tower T is mounted. Hydraulic cylinder 26 raises and lowers tower T to and from the vertical for proper orientation of the tower T over the well bore.

A hydraulic piston assembly 20 extends between the lower portion of the tower T and a "V"-shaped crown support for supporting the crown block means C. Pulley wheels 24*a* and 24*b* support the extension of inner piston 20*a* of hydraulic cylinder assembly 20 through the engagement of pulley wheels 24*a* and 24*b* with rear members 12. As hydraulic cylinder assembly 20 expands through one stroke or cycle, the crown block means C travels from a lower position to an upper position for raising the engaged drill string. With the single stroke of hydraulic cylinder assembly 20, a single tubular member of the drill string is raised and exposed.

The auxiliary rig A of the present invention extends from the upper end of the tower T. Mounting means M mounts the auxiliary rig A with the tower T. Formed with the upper end of front members 10*a* and 10*b* and rear members 12*a* and 12*b* are tower mounting fingers or ears 28 having an opening formed therein. Rig mounting fingers or ears 30 having openings therein of similar dimension to the openings in tower mounting fingers 28 are formed at the base of auxiliary rig A. The auxiliary rig A is placed upon the tower T with a tower mounting finger 28 being adjacent to a corresponding rig mounting finger 30. A pin or bolt 32 is then placed in the passageway formed by the opening in the tower mounting finger 28 and the adjacent opening in the rig mounting finger 30. Pins 32 secure the auxiliary rig A upon the tower T against undesired removal.

Preferably the racking or auxiliary tower R of the auxiliary rig A comprises racking tower first and second front members 34*a* and 34*b* and racking tower first and second rear members 36*a* and 36*b*. Members 34*a*, 34*b* and 36*a*, 36*b* are formed preferably of a tubular segment comparable with that of the members 10*a*, 10*b* and 12*a*, 12*b* of the tower T. Front members 34*a* and 34*b* and rear members 36*a* and 36*b* are formed into a tower-like structure with the interstitial spaces between front members 34*a* and 34*b* and rear members 36*a* and 36*b* corresponding to the distances between the front members 10*a* and 10*b* and rear members 12*a* and 12*b* of tower T. Racking tower horizontal braces 38 and racking tower cross braces 40 extend between a front member 34*a* and 34*b* and rear member 36*a* and 36*b* and between the rear members 36*a* and 36*b* providing structural strength of racking tower R. Preferably, braces 38 and 40 do not extend between front members 34*a* and 34*b*.

First front member 34*a* and first rear member 36*a*, forming one side of the racking tower R, are joined at the uppermost end of member 34*a* and 36*a* at racking tower first peak 42*a*. Second front member 34*b* and second rear member 36*b*, forming a second side of the racking tower R, are joined at the uppermost end of members 34*b* and 36*b* at racking tower second peak 42*b*. Upper portions of rear members 36*a* and 36*b* are bent forward and to the outside of racking tower R at bends 36*c* and 36*d*. The corresponding front members 34*a* and 34*b* have the upper portions thereof bent rearwardly and toward the inside of racking tower R at bends 34*c* and 34*d*. Thus, first front member 34*a* and first rear member 36*a* are joined at racking tower peak 42*a* and second front member 34*b* and second rear member 36*b* are joined at racking tower second peak 42*b*.

A gin pole 44 is mounted perpendicular from support bar 46, which support bar 46 extends between the peaks 42*a* and 42*b*. Braces 48, mounted with racking tower R, additionally support gin pole 44. A wire or cable 52, extending between reel 54 of moving means V and slip means S, passes over pulley wheel 50 mounted with the upper end of the gin pole 44.

Moving means V includes winch means 56 and reel 54 for controllably tensioning the tubular members at a desired level for moving the tubular members between an upper position and lower position for raising and lowering the tubular members. Generally, winch means 56 is a hydraulic winch which maintains cable 52 at a constant tension for raising and lowering slip means S.

The front cable portion 52*a* of cable 52 extends between pulley wheel 50 and slip means S and generally lies along the longitudinal axis of the drill string. It is desired that the area between the front members 10*a* and 10*b* of the tower T and the area between front members 34*a* and 34*b* of the racking tower R, be free of obstructions such as braces 14, 16, 38 and 40 allowing free movement of the drill string (not shown), crown block means C and slip means S within the frontal area of the tower T and racking tower R.

Preferably winch 56 and reel 54 are mounted with a cross support 18*e* extending between skids 18 or between extensions 18*a* added to lengthen skids 18 for increased support due to the additional height of tower T by racking tower R. Removable outriggers or braces 18*b* with adjustable levels 18*c* and angles 18*d* are removably bolted onto skids 18 to provide additional lateral support for the increased height of the drilling rig D from the auxiliary rig A. Supports 18*d* extend between outriggers 18*b* and skids 18 to stabilize the base B.

A racking table 58 is adapted to be mounted with the base B of drilling rig D and disposed adjacent the lower end of the drill tower T for supporting vertically stored threadedly interconnected pairs of tubular members.

Belly board 60 with tower T controls undesired movement of the tubular members from the desired position substantially in line with the longitudinal axis of the drill string when the tubular members are not connected with or stabilized by the drill string.

Figure 3:
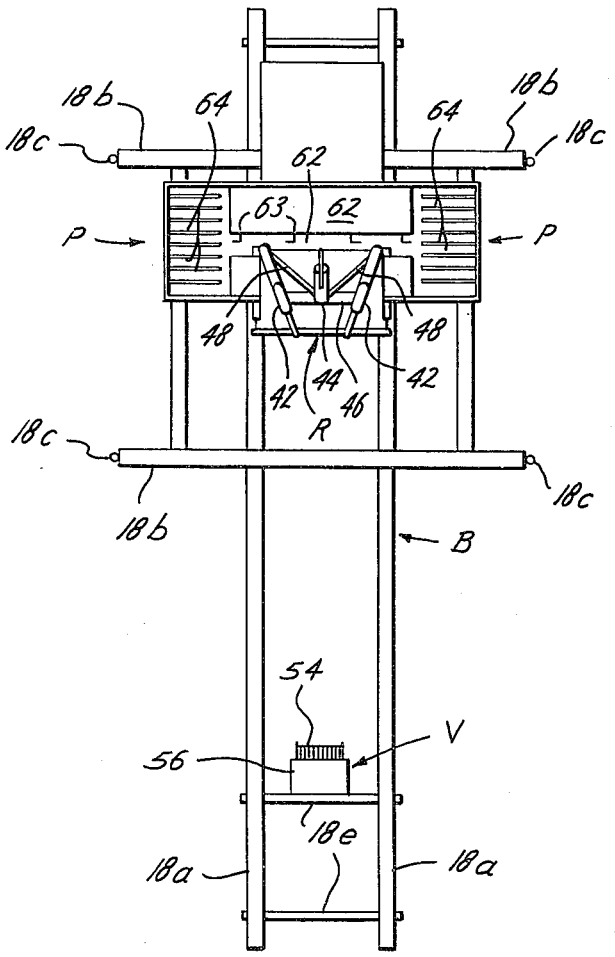

A pipe rack P with the upper end of racking tower R permits ease in the substantially vertical racking and storing of the interconnected pairs of tubular members with the racking tower R. Preferably, pipe rack P includes a platform 62 for supporting an operator, secondary winch controls 70 (FIG. 1), and mounts a plurality of spaced-apart pipe rack fingers 64 (FIG. 3). The upper end of the substantially vertical pairs of tubular members are racked between pipe rack fingers 64 for vertically orienting the double joints. When the pairs of tubular members are stored vertically, it is preferred that the double joints be supported by and extend from the racking table 58 upwardly to the pipe rack fingers 64 of pipe rack P for protecting the threaded connections at the upper and lower ends of the tubular members. It is desired that the front portion 52*a* of cable 52 passes between the platform 62 of the pipe rack P and the racking tower R to limit the undesired movement of the slip means S. Hooks 63 mounted with platform 62 engage the front cable portion 52*a* for controlling the position of slip means S.

Operation

In the use or operation of the auxiliary rig A of the present invention, the racking or auxiliary tower R of the auxiliary rig A is mounted upon the primary rig D with mounting means M. The tower T is placed in the desired substantially vertical position and adjustable levels 18*c* are adjusted to make secure contact with the ground surface upon which the primary rig D is placed.

An operator controls the operation of the present invention with primary controls 68 located near the base B. If a drill string is to be tripped out of the well, the hydraulic cylinder 20 is collapsed and the crown block C is positioned at the lowest location with respect to the tower T. The crown block C engages the upper portion of the exposed drill string and the hydraulic cylinder is then energized, extending inner piston 20*a*. As inner piston 20*a* is extended, the crown block C is raised and thereby crown block C raises the drill string fully exposing a single joint or tubular member. With the crown block C fully raised to its upper position, the slip means S engages the exposed tubular member and moving means V selectively tensions the drill string. Crown block C is then disengaged from the drill string.

The hydraulic cylinder 20 collapses a second time for the second cycle and crown block C travels toward the base B of tower T. The crown block C again engages the drill string and hydraulic cylinder 20 extends raising crown block C and the drill string. Moving means V controlled by controls 68 raises slip means S correspondingly to maintain the drill string at the desired tension. At this point a pair of tubular members is exposed and is typically disconnected from the drill string in a conventional manner.

The double joint, having been disengaged from the crown block C, is now moved into the desired position by moving slip means S. Typically, an operator standing upon platform 62 operates secondary winch controls 70 mounted with pipe rack P to selectively position the lower end of the double joint in racking table 58 and the upper end of the double joint between adjacent pipe rack fingers 64. The upper cable portion 52*a* is moved laterally to reposition the double joint and slip S from the longitudinal axis of the drill string to the desired position between the pipe rack fingers 64.

With the auxiliary rig A of the present invention a double joint or a pair of tubular members can be disconnected from the drill string as a single unit. The present auxiliary rig A eliminates the additional time previously required to disconnect the threaded interconnection between the two tubular members of the pair. The time necessary to trip a drill string out of a well is substantially reduced and approximates one half of the time previously required.

The operation of the auxiliary rig A of the present invention for joining a double joint to a drill string is substantially the reverse of the above steps. A similar savings in time to increase the length of the drill string is realized over the previous methods.

The foregoing disclosure and description of the invention are illustrative and explanatory thereof, and various changes in the size, shape and materials as well as in the details of the illustrated construction may be made without departing from the spirit of the invention.

We claim:

1. An auxiliary rig adapted to be used in combination with a primary drilling rig, the primary rig having an elongated upstanding drill tower, a base therefor, and crown block means with the drill tower for raising and lowering tubular members for vertical storage of threadedly interconnected pairs of tubular members of the type forming a drill string, comprising:

an auxiliary tower adapted to be mounted to the apex of a primary rig forming an elongate extension thereof, said auxiliary tower for receiving interconnected pairs of tubular members raised and lowered by the crown block means for reducing the tripping time of the tubular members into and out of the well;

mounting means with said auxiliary tower for detachably mounting said auxiliary tower to the apex of a primary rig;

a pipe rack with said auxiliary tower for permitting ease in substantial vertical racking and storing of the interconnected pairs of tubular members with said auxiliary tower;

movable slip means operably guided by said auxiliary tower for releasably supporting the pairs of tubular members; and moving means with the primary rig for moving said slip means to selectively tension the drill string.

2. The rig of claim 1 including:

a racking table adapted to be mounted with the primary rig and disposed adjacent the lower end of the primary rig for providing support of vertically stored threadedly interconnected pairs of tubular members.

3. The rig of claim 1, including:

removable bracing mounted with the base of the primary rig for supporting the added height of the auxiliary tower mounted to the apex of the primary rig.

4. The rig of claim 1 wherein said moving means includes:

winch means for tensioning the tubular members at a described level and for moving the tubular members into alignment with said pipe rack; and, a cable extending between said winch means and said slip means for raising and lowering said slip means.

5. A drilling rig for vertical storage of threadedly interconnected pairs of tubular members of the type forming a drill string for use in drilling a well, comprising:

a primary rig having an elongated upstanding drill tower, a base for supporting said primary rig, said primary rig for use in drilling operations with the tubular members;

crown block means movably mounted with said primary rig for selectively raising and lowering the interconnected pairs of tubular members with respect to said drill tower;

an auxiliary tower adapted to be mounted to the apex of said primary rig forming an elongated extension thereof, said auxiliary tower for receiving interconnected pairs of tubular members raised and lowered by said crown block means for reducing the tripping time of the tubular members into and out of the well;

mounting means with said auxiliary tower for detachably mounting said auxiliary tower to the apex of said primary rig;

a pipe rack with said auxiliary tower for permitting ease in substantial vertical racking and storing of the interconnected pairs of tubular members with said auxiliary tower;

movable slip means operably guided by said auxiliary tower for releasably supporting the pairs of tubular members; and, moving means with said primary rig for moving said slip means to selectively tension the drill string.

6. The rig of claim 5 including:

a racking table adapted to be mounted with said primary rig and disposed adjacent the lower end of said primary rig for providing support of vertically stored threadedly interconnected pairs of tubular members.

7. The rig of claim 5 including:

removable bracing mounted with the base of said primary rig for supporting the added height of the auxiliary tower mounted to the apex of said primary rig.

8. The rig of claim 5 wherein said moving means includes:

winch means for tensioning the tubular members at a desired level and for moving the tubular members into alignment with said pipe rack; and, a cable extending between said winch means and said slip means for raising and lowering said slip means.

* * * * *